US006056626A

United States Patent [19]

Fildan

[11] Patent Number: 6,056,626

[45] Date of Patent: May 2, 2000

[54] FLAT SLIDE ASSEMBLY FOR LINGERIE

[76] Inventor: Gerhard Fildan, Wohnpark Alte Erlaa, Anton-Baumgartner-Str. 44, C 4 17 01, A-1232 Vienna, Austria

[21] Appl. No.: 09/363,057

[22] Filed: Jul. 29, 1999

[51] Int. Cl.[7] ..... A41C 1/00; A44B 11/02

[52] U.S. Cl. ..... 450/86; 450/1; 24/197; 24/198; 24/200; 2/336

[58] Field of Search ..... 450/86, 1, 18, 450/25, 63, 64, 88, 93; 24/197, 198, 200; 2/67, 336, 338, 312–315, 320, 321, 335, 326, 268, 271

[56] References Cited

U.S. PATENT DOCUMENTS

| | | | |
|---|---|---|---|
| 2,224,773 | 12/1940 | Shaulson | 24/200 |
| 2,260,060 | 10/1941 | Shaulson | 24/200 |
| 3,075,268 | 1/1963 | Schwartz | 24/200 |
| 3,077,650 | 2/1963 | Horne | 24/200 |
| 3,112,750 | 12/1963 | Jonas | 24/200 X |
| 3,115,878 | 12/1963 | Markham | 24/200 X |
| 3,161,931 | 12/1964 | Zif | 24/200 |
| 3,164,154 | 1/1965 | Simonsen | 24/200 |
| 3,290,696 | 12/1966 | Rosenweig | 2/323 |
| 5,590,443 | 1/1997 | Fildan | 24/200 |

*Primary Examiner*—Gloria M. Hale
*Attorney, Agent, or Firm*—Herbert Dubno

[57] ABSTRACT

An extremely flat slide for brassiere straps has a cross bar offset to one side so that the strap loop around it lies wholly within the thickness of the slide. The strap section which passes through the ring affixed to the brassiere cup is attached to the slide, e.g. at the sewing flange or via a weld at a welding flange.

23 Claims, 10 Drawing Sheets

FIG. 1
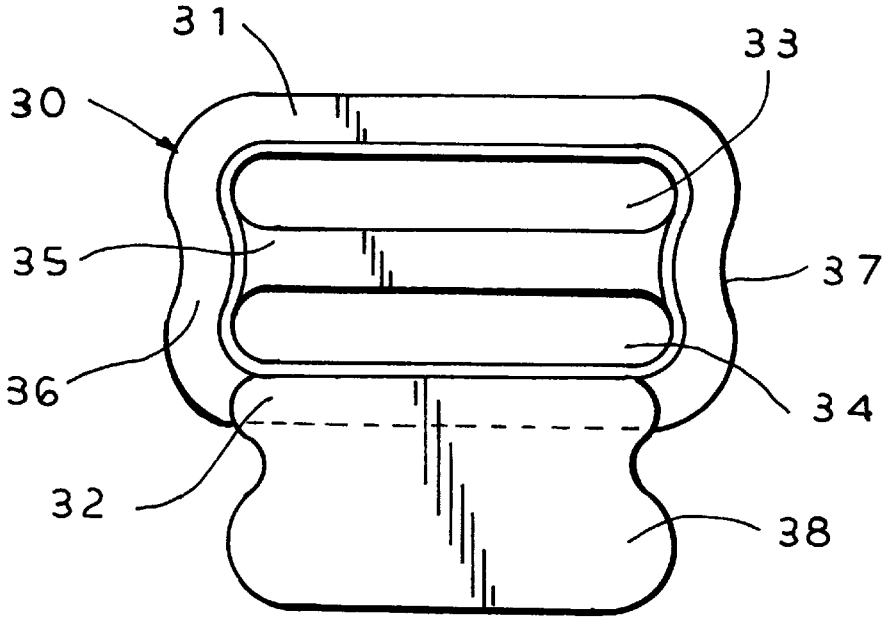
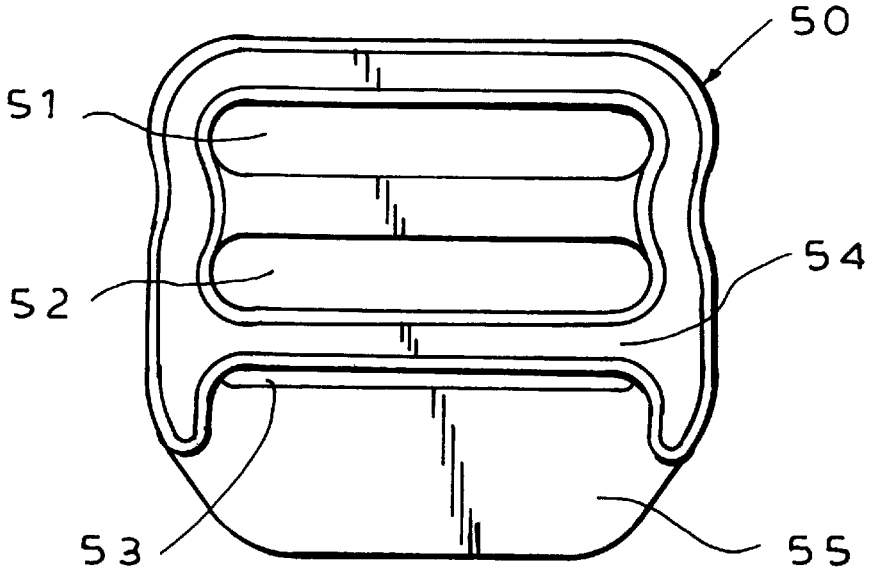
FIG. 4

FIG.13
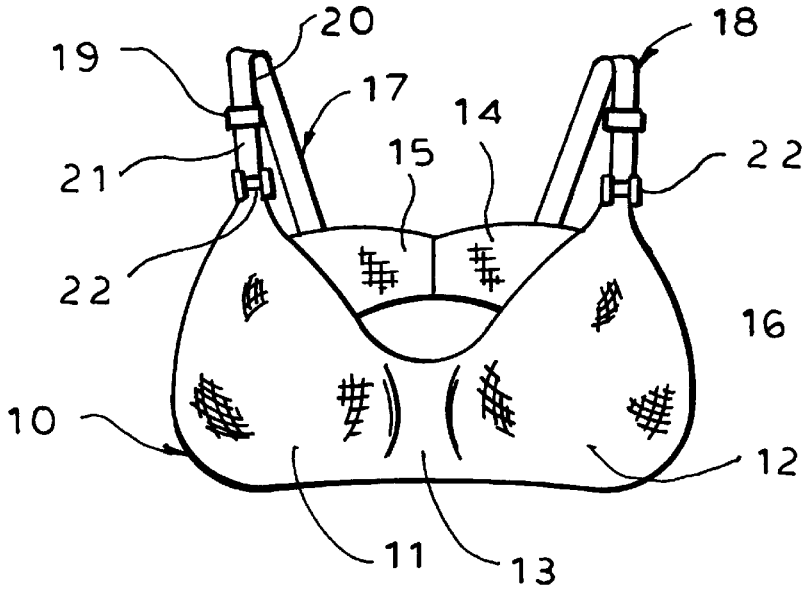
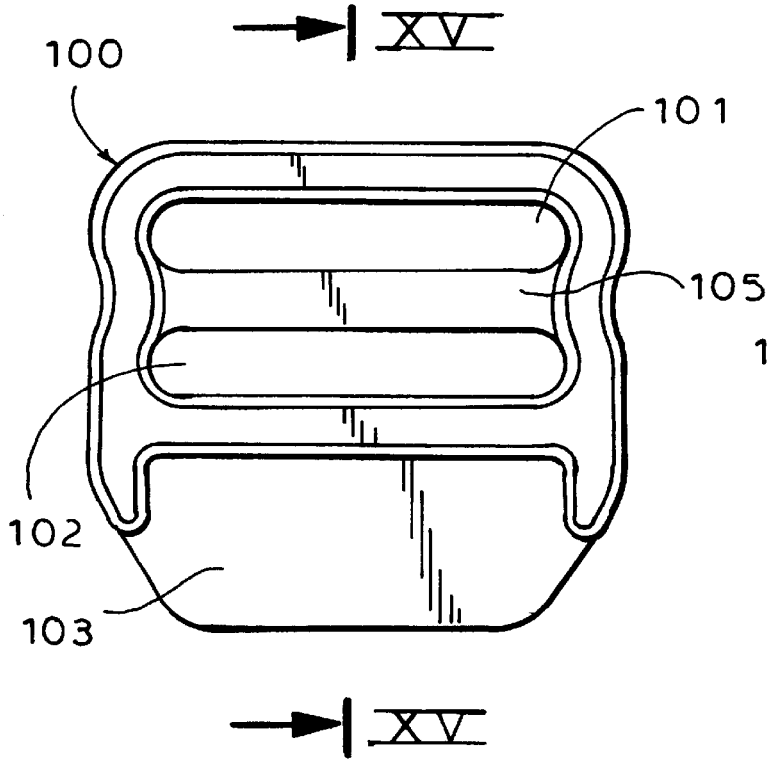
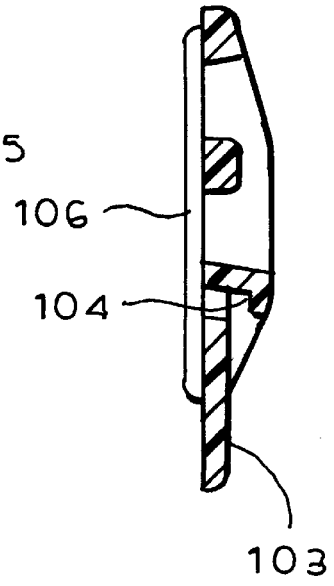
FIG.14 FIG.15

FIG.18
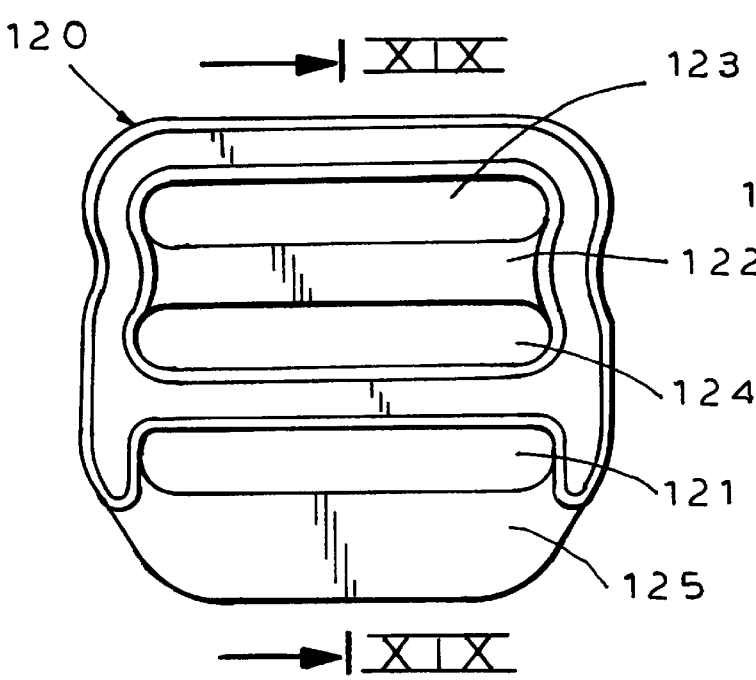
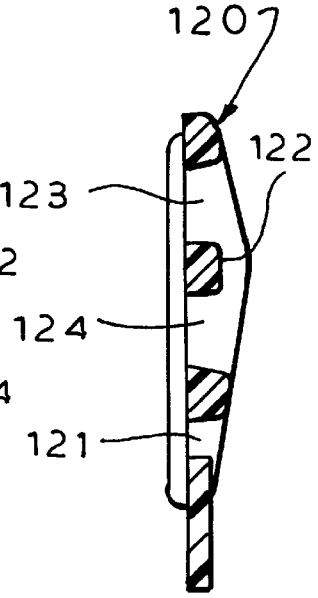
FIG.19
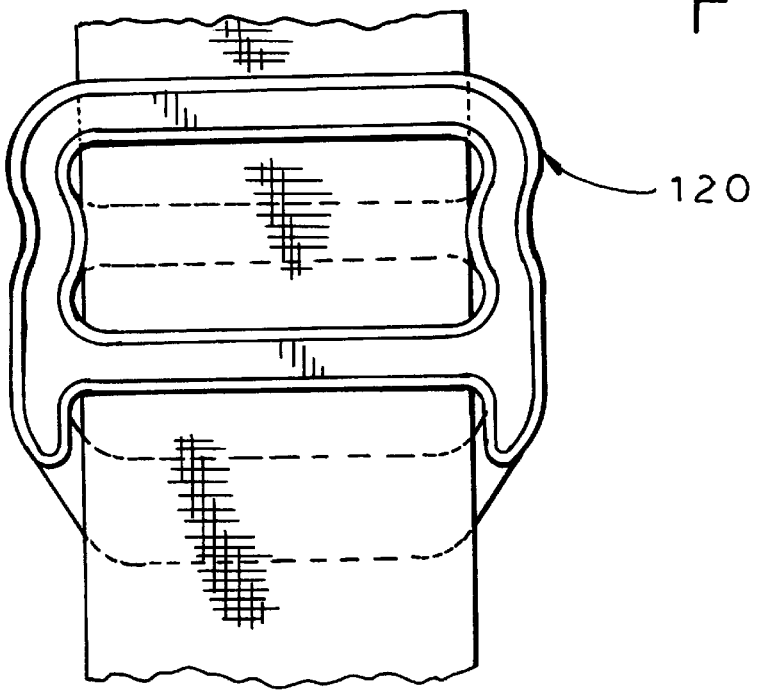
FIG.20

FLAT SLIDE ASSEMBLY FOR LINGERIE

FIELD OF THE INVENTION

My present invention relates to a flat slide assembly for lingerie and, more particularly, to an adjustable brassiere strap slide which can be used along a shoulder strap of a brassiere to adjust the effective length thereof.

BACKGROUND OF THE INVENTION

A brassiere strap slide has, in the past, frequently comprised a frame having a pair of bars or limbs separated by a cross bar which defined oval slots with those limbs. The brassiere strap passes from one side of that slide body through one of the oval slots, around the cross bar, out through the other slot and then again along the outer limb of the slide.

Problems with the slipping of the slide are discussed in my copending application Ser. No. 09/304,876 filed May 4, 1999 and incorporated in its entirety herein by reference.

The brassiere strap passing through the slide can engage through a ring attached to a brassiere cup so that with movement of the slide along the strap or with movement of the strap through the slide the effective length of the strap and hence the effective length of a shoulder strap of the brassiere can be relatively adjusted.

The free end of the strap segment returning from the ring can be looped around one of the bars of the slide and stitched to close the loop.

A major problem with such a slide arrangement is the thickness of the unit. For example, since the cross bar was generally of the same thickness as the outer limbs or bars of the slide and had at least two thicknesses of the strip therearound in the loop end of the strip segment from the ring, and the strap segment which was movable in the slide also passed partly around the loop and the cross bar, at least at the cross bar there were three thicknesses of the strap fabric and the overall thickness of the assembly included the cross bar thickness and the three strap thicknesses. At the slider, therefore, the strap system provided for length adjustment was quite bulky, was readily visible through outer garments, frequently pressed uncomfortably against the wearer if the brassiere was tight or tight outer garments were worn over the brassiere, and generally was inconvenient to manipulate.

A somewhat different approach looped the return strap segments from the ring about the lower limb or bar of the slider frame, but here as well there were three thicknesses of the fabric in addition to a thickness of the lower limb or bar.

Efforts to minimize the thicknesses of the outer bars or limbs of the slide to decrease the overall thickness and make the slide arrangement flatter were only partly successful in making the slide less visible beneath outer garments or less bulky.

OBJECTS OF THE INVENTION

It is, therefore, the principal object of the present invention to provide an improved adjustable strap assembly for lingerie and most specifically for brassieres, whereby the drawbacks enumerated above can be obviated.

Another object of this invention is to provide an improved adjustable strap and slide assembly for lingerie like brassieres which have a flatter aspect, are less bulky and are therefore less likely to show through an outer garment.

Another object of the invention is to provide a more reliable slide for lingerie strap assemblies and especially the shoulder strap of a brassiere, which is more readily adjustable, flatter and more secure against unintentional movement than earlier brassiere bodies.

SUMMARY OF THE INVENTION

These objects and others which will become apparent hereinafter are attained, in accordance with the invention, by providing on a slide of the aforedescribed type, along the lower outer limb, a flange which is thinner than the slide body and onto which the strap segment returned from the ring can be attached by welding or stitching. In addition, the cross bar is of reduced thickness, i.e. has a thickness less than that of the outer limbs or bars of the frame and is not disposed symmetrically in the median plane of the body of the slide, but rather is offset toward the side of the body or frame turned toward the torso of the wearer. As a result, the loop of the adjustable strap segment which passes partly around the cross bar, can remain fully within the thickness of the frame and, where the adjustable strap segment and the strap segment running from the ring overlie one another, there is a maximum of two thicknesses of the strap fabric. Since the fixed end of the strap can be stitched to the flange, which can be a sewn flange according to the invention, i.e. a flange through which the stitches can be passed by a sewing machine needle, the strap segment which is secured may be a single layer or, if the flange is provided with a further oval slot, a double layer with the strap segment passing through this slot so as to lie on both sides of the flange. In this case, while the secured strap segment is present in two layers on the slide, the overall thickness is still relatively small since the flange can have a thickness which can be a small fraction of the overall thickness of the slide, say one-third of the overall slide thickness.

According to another feature of the invention, the flange can be a welding flange and the secured strap segment can be affixed by thermal or ultrasonic welding to the flange. To facilitate such welding, the flange can be formed with a plurality of projections which penetrate into the strap during the welding process.

The slip of the adjustable strap segment relative to the slide can be limited if the slide is formed with sharp edges, e.g. by having at least one side of the slide flat or planar with no portions projecting beyond the plane. The slide can be fabricated in a simple mold in which the planar surface is formed by a flat plate.

According to a feature of the invention, the flange can be a welding flange formed with a recess turned toward the torso of the wearer and in which a strip segment is received, the outer surface of the flange being exposed and carrying, if desired, decorative indicia which can be embossed on the slide. The slide can be injection molded from a synthetic resin material, e.g. a polyamide or polyoxymethylene.

The adjustable strap assembly can thus comprise:

a slide having a frame defined by a pair of parallel outer limbs, transverse limbs interconnecting the outer limbs at opposite ends thereof, respective oval slots along each of the outer limbs, a crossbar interconnecting the transverse limbs between the slots, and a flange adjacent one of the outer limbs, the frame having a side adapted to be turned toward a body of a wearer and a side adapted to be turned away from the body of the wearer, the crossbar being thinner than the outer limbs and being offset toward one of the sides; and strap means for adjustment relative to the slide, the strap means including a strap segment passing through one of the slots from a first of the sides, around the crossbar and out through the other of the slots onto the first of the sides, and means for securing another strap segment to the flange.

The slide itself is the subject of another aspect of the invention and comprises a slide body having a frame defined by a pair of parallel outer limbs, transverse limbs interconnecting the outer limbs at opposite ends thereof, respective oval slots along each of the outer limbs, a crossbar interconnecting the transverse limbs between the slots, and a strap-attachment flange adjacent one of the outer limbs, the frame having a side adapted to be turned toward a body of a wearer and a side adapted to be turned away from the body of the wearer, the crossbar being thinner than the outer limbs and being offset toward one of the sides.

According to the feature of the invention, the slide is provided with an overhang for the free end of the strap which is affixed to the sewing flange. This overhang can extend over the auxiliary slot which may or may not be used in this embodiment. The end protecting roof or overhang is provided on the side of the slide opposite the body side.

It has been found, further, that with modern shoulder straps for brassieres, the outer side of the strap may have a different texture or appearance from the side turned toward the body. For example, the outer side may be shiny whereas the inner side may be dull. With a stringing of the strap through the slide in which opposite ends of the strap are visible on the portion extending to the ring and on the portion returning from the ringing, the appearance of the brassiere may be unsatisfactory.

In another embodiment of the invention, therefore, the auxiliary slot may be made somewhat wider and the strap is strung through the slider so as to pass through all three slots on its way to or from the ring and, since the stretch of the strap from the auxiliary slot to the ring can cover the stretch of the strap affixed to the flange of the slide, only one side of the strap is visible.

An arrangement in which the strap passes through three slots before it reaches the ring has been found to be particularly advantageous because the three slot retention further limits slippage of the slide in use.

BRIEF DESCRIPTION OF THE DRAWING

The above and other objects, features, and advantages will become more readily apparent from the following description, reference being made to the accompanying drawing in which:

FIG. 1 is an elevational view of one side of a slide for an adjustable strap assembly for a brassiere according to the invention;

FIG. 4 is a view similar to FIG. 1 of another embodiment of the slide;

FIG. 13 is a diagrammatic view of a brassiere utilizing adjustable strap assemblies according to the invention;

FIG. 14 is an elevational view of a slide provided with an end protecting roof or overhang;

FIG. 15 is a cross sectional view thereof taken along the line XV—XV of FIG. 14;

FIG. 18 is a view similar to FIG. 14 of another slide for a shoulder strap according to the invention;

FIG. 19 is a cross sectional view taken along the line XIX—XIX of FIG. 18;

FIG. 20 is a view of the slider provided with a shoulder strap such that only one side thereof is visible;

SPECIFIC DESCRIPTION

Figure 2:
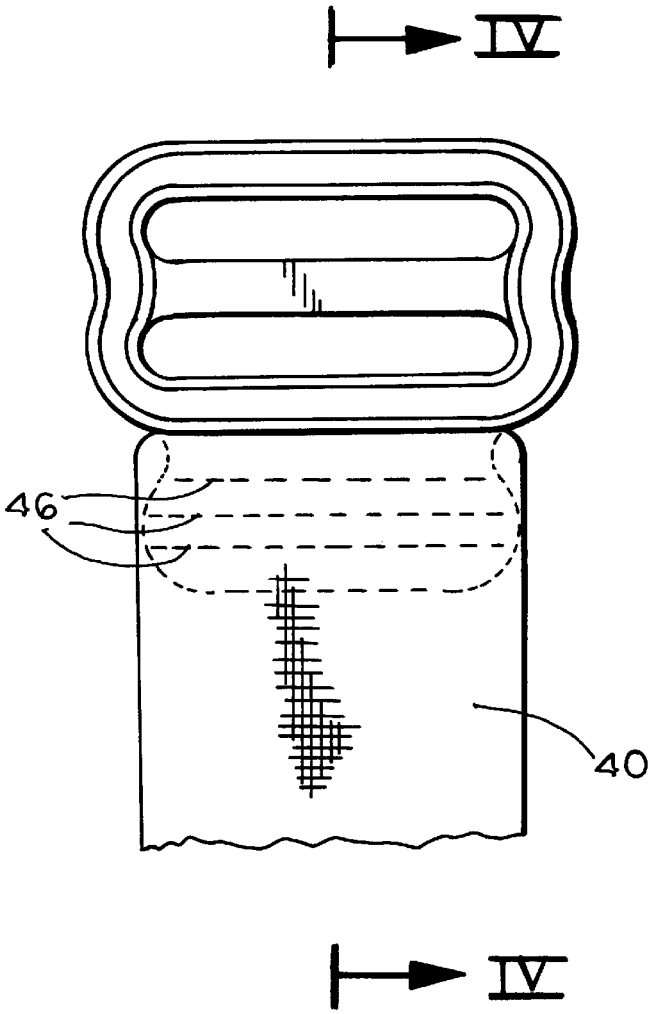
FIG. 2 is a view similar to FIG. 1 but showing the strap segment which is to be secured to this slide in place thereon.

Referring first to FIG. 13 in which I have shown a brassiere 10 having a pair of cups 11 and 12 interconnected at 13 and provided with back flaps 14 and 15 which can be joined at 16, it can be seen that each cup is provided with an adjustable strap assembly 17 or 18. Each of the assemblies includes a slider 19 and a shoulder strap segment 20 which is movable through the slider and has a segment 21 passing through a ring 22 and affixed to the slider 19, as will be described in greater detail hereinafter.

Figure 3:
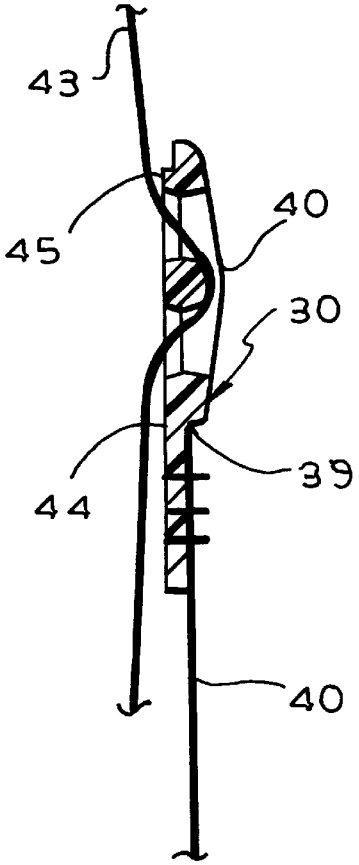
FIG. 3 is a cross sectional view taken along the line III—III of FIG. 2 and showing the bar of the adjustable strap segment.

In one embodiment of such a slider, shown at 30 in FIGS. 1–3, the slider body is in the form of a frame having longitudinal limbs or bars 31 and 32 defining oval slots 33 and 34 with a cross bar 35 bridging the transverse limbs 36 and 37 of the frame. The bar or limb 32 is formed with a sewing flange 38 which abuts a step 39 and receives a free of the strap segment 40, running to the ring, e.g. the ring 22.

The slider is injection molded polyoxymethylene and, as can be seen from FIG. 3, the transverse limbs 36 and 37 can rise from the thickness of the bar 31 or 32 to the center region at which it may be almost twice the thickness of the cross bar 35, the center region being shown at 41 in FIG. 2.

The other strap segment 43 passes through the slot 33 from the side 44 of the frame turned toward the body, is then looped round the cross bar 35 and passes out through the slot 34 to lie along the aforementioned side of the sewing flange 38. The sewing flange 38 may have a thickness of 0.6 mm while the overall thickness of the slide may be 1.8 mm.

Along the side 44, to ensure gripping of the slide and the strap section 43, the slide may have a ridge 45 along the slot 43.

The strap segment 40 is stitched through the sewing flange and is therefore secured thereto by rows 46 of stitches.

It will be apparent that the strap segment 43 does not pass around any bulked up or looped portion of the strap segment 40 which, in earlier strap systems may have been looped around one of the slide limbs or the cross bar so that the bulk attributable to multiple thicknesses of the strap is avoided in the flat one layer slide with the sewing flange of FIGS. 1–3.

Figure 5:
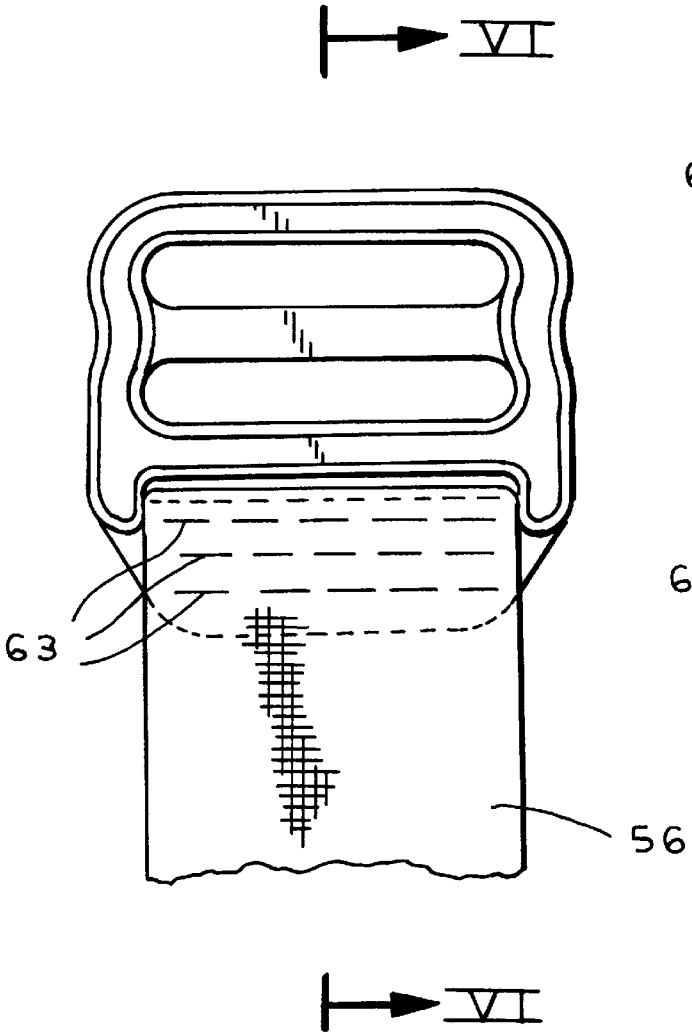
FIG. 5 is a view of the slide of this second embodiment provided with the secured strap segment.
Figure 6:
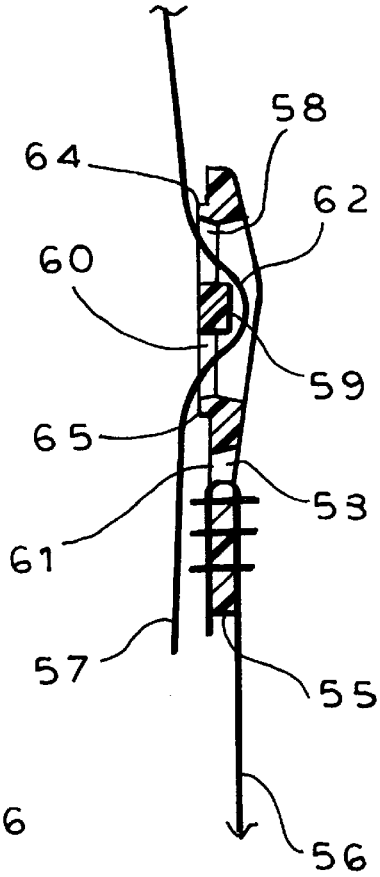
FIG. 6 is a cross sectional view along the line VI—VI of FIG. 5.

FIGS. 4–6 show a similar construction wherein, however, the slide 50, in addition to the oval openings 51 and 52, has a further opening 53 below the cross bar 54. This opening 53 is provided between the sewing flange 55 and the bar 54.

In this embodiment, the strap segment 56 can be passed through the slot 53 and thus can lie along both flanks of the sewing flange 55 to which the strap segment is stitched through. The adjustable shoulder strap section 57 passes through the slot 58 and around the cross bar 59 before passing out through the slot 60. In all of the embodiments described here, the cross bar 59 is offset toward the side 61 of the slide so that the loop 62 of the strap section 57 remains wholly within the thickness of the slide.

The stitching of the strap section 56 here passes through two thicknesses thereof and the sewing flange.

In this embodiment, ridges 64 and 65 are provided along the bars 51 and 54 to engage the strap section 57 when the latter is under tension and to assist in retaining the slide in position along the strap section 57.

Figure 7:
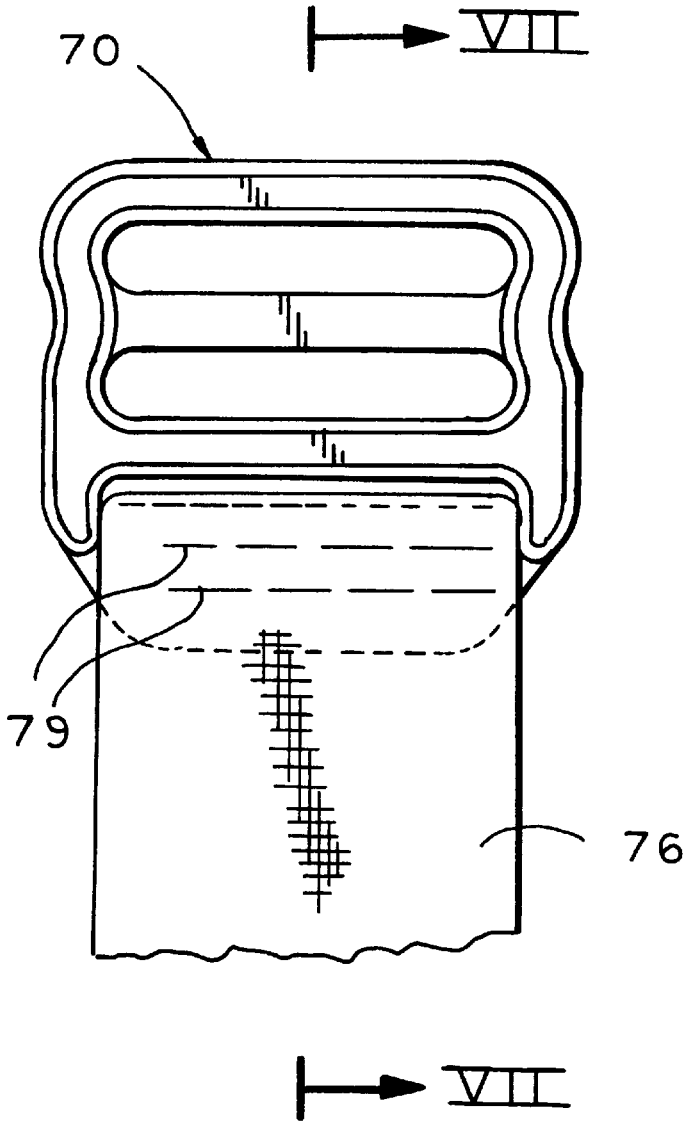
FIG. 7 is a view similar to FIG. 5 illustrating still another embodiment of the invention in which sharp edges prevent slip of the adjustable strap.
Figure 8:
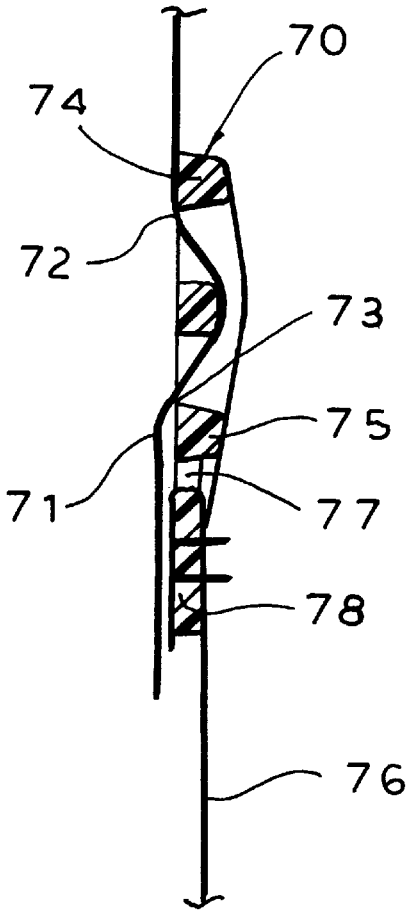
FIG. 8 is a cross sectional view along the line VIII—VIII of FIG. 7.

FIGS. 7 and 8 illustrate an embodiment of the invention wherein the frame 70 is completely flat along the side 71 so that sharp edges at 72 and 73 of the longitudinal limbs 74 and 75 can bite into the strap section 71 to held the strap and the slider against undesired slip.

Here the strap section 76 is passed through the slot 77 above the sewing flange 78 and then loops around the latter so that the stitching 79 passes through a turned over portion of the strap in addition to the sewing flange 78.

Figure 9:
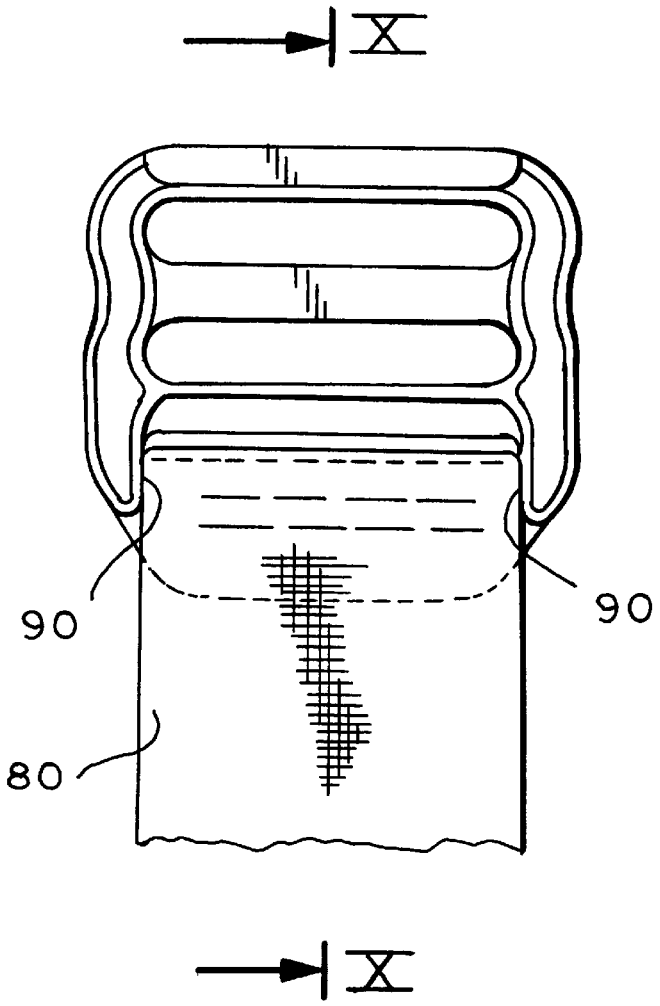
FIG. 9 is a view similar to FIG. 5 of an embodiment in which ridges are provided on opposite sides of the frame body.
Figure 10:
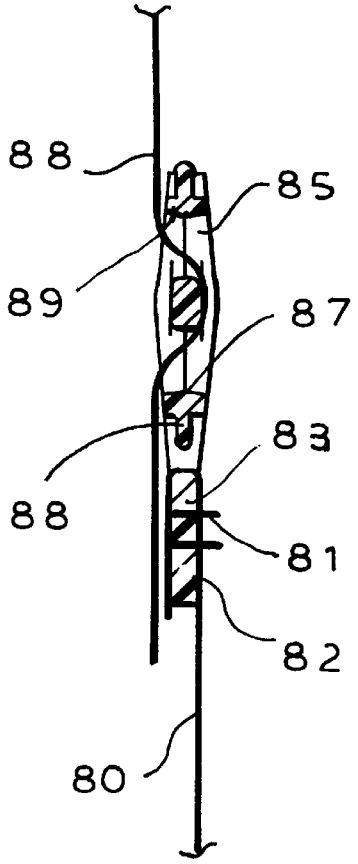
FIG. 10 is a cross sectional view taken along the line X—X of FIG. 9.

In the embodiment of FIGS. 9 and 10 the strap section 80 is connected to the sewing flange 81 by stitchings 82 and 83 while the strap section 84 passes through the slot 85, around the cross bar 86 and out through the slot 87 along the limb 88. Ridges 89 play the same role here as the ridges of the two previous embodiments.

Here the strap section 80 is received between the cheeks 90.

Figure 11:
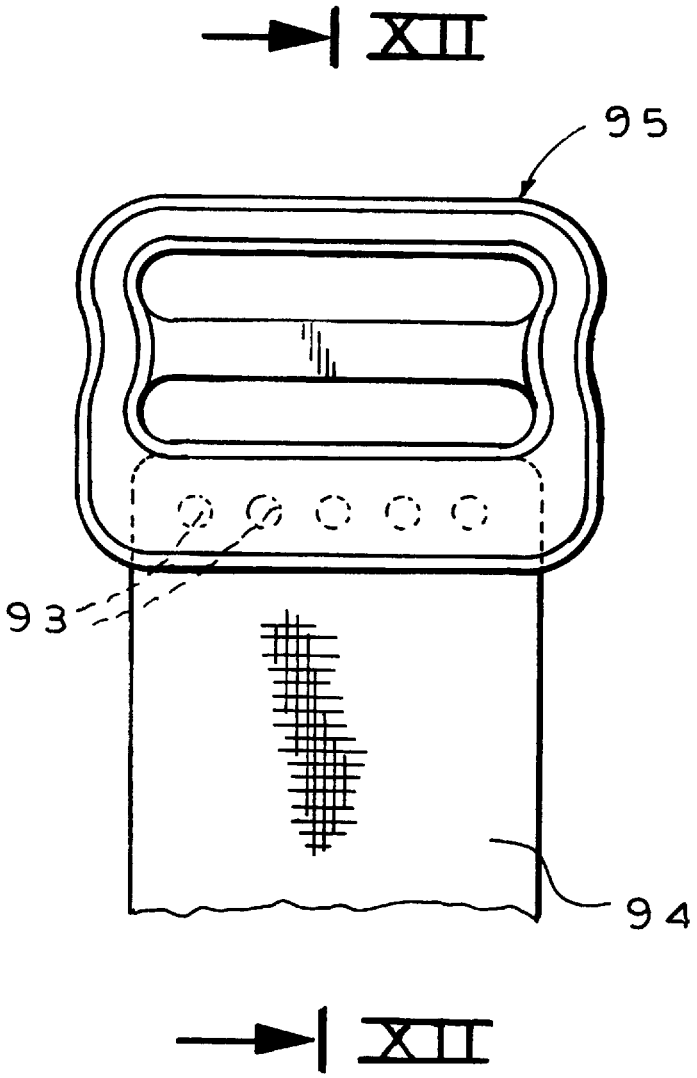
FIG. 11 is an elevational view showing an assembly of the invention without the adjustable strap segment, utilizing welding to secure a strap segment to the slide.
Figure 12:
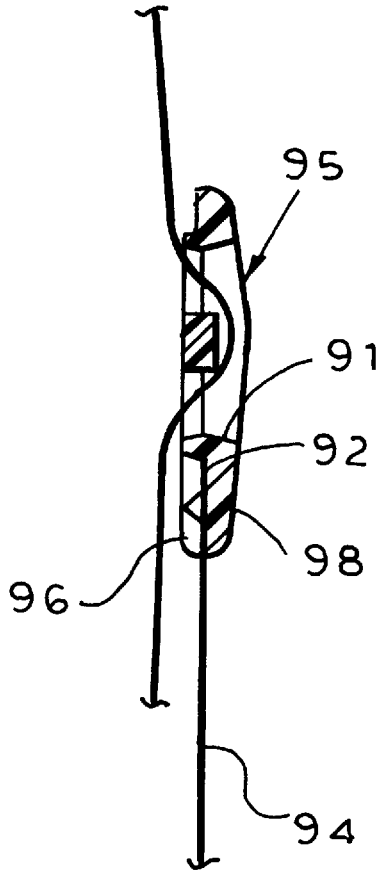
FIG. 12 is a cross sectional view long the line XII—XII of FIG. 11 but with the adjustable strap segment in place.
Figure 16:
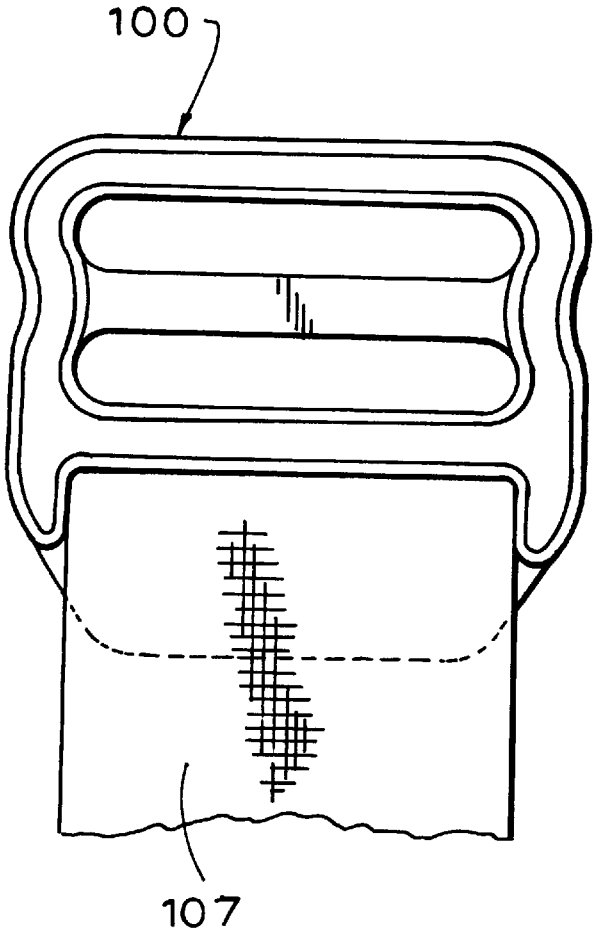
FIG. 16 is a view of this slide with a strap end affixed thereto.

In the embodiment of FIG. 11, the lower limb 91 is formed with a welding flange 92 instead of with a sewing flange. The welding flange 92 can be provided with a row of projections 93 which can engage in the strap section 94 during the welding process. The slide 95 is otherwise similar to that described, except that it is formed with a compartment 96 in which the strap section 94 engages. The fabric is thermally welded to the slider in the recess 96 and thus is permanently secured thereto.

In all of the embodiments described, the flat slide tends to remain in position and does not tend to cock to one side or another. It can make use of other methods of attaching the strap sections to the slider. The surface 98 of the flange 92, which is exposed in the embodiment illustrated, can be embossed with legible matter, for example promoting the flat slide of the invention, or of a decorative nature.

Figure 17:
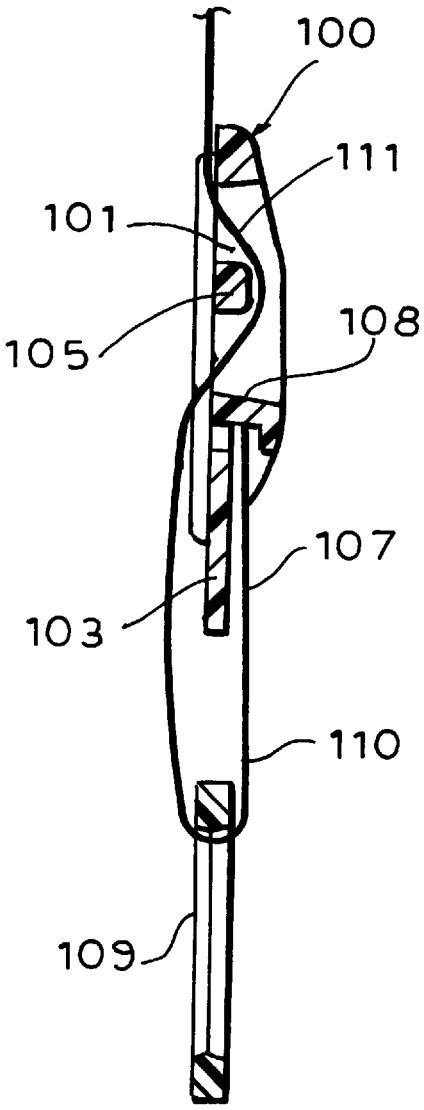
FIG. 17 is a cross sectional view of the slider of FIGS. 14 through 16 threaded with the shoulder strap of a brassiere.

FIGS. 14 to 17 illustrate an embodiment of the invention in which the slide 100, as in previous embodiments, has slots 101 and 102 but wherein the flange 103 is overhung by an end protecting roof 104. The central bar 105 is here offset toward the side 106 of the slide which is to lie along the body. An end 107 of the strap can be stitched or otherwise attached to the flange 103 so that the free end 108 of this strap segment 107 is hung by the roof 104 and protected against fraying thereby. As shown in FIG. 17, the strap from the segment 107 passes through the ring 109 which is attached to the brassiere and then along the body side 106 of the slide 100, around the bar 105 and out through the slot 101.

In this system as in others described previously, both the front 110 of the strap and the back 111 can be visible from the side of the strap opposite the body side.

Since the front of the strap may be shiney while the back of the strap may be dull, the appearance of two sides of the strap can be unesthetic.

This problem can be avoided with the slide 120 shown in FIGS. 18 and 19, wherein the auxiliary slot 121 is widened. Here the central bar 122 separates the upper slot 123 from the lower slot 124 and a sewing flange 125 is provided below the auxiliary slot 121.

Figure 21:
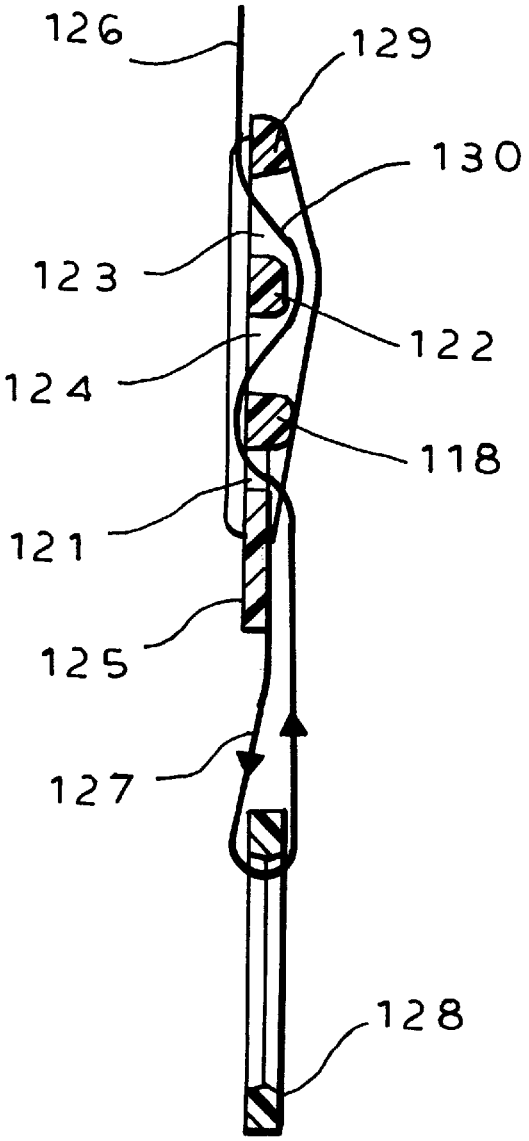
FIG. 21 is a threading diagram for the slide of FIGS. 18 to 20.

As can be seen from FIGS. 20 and 21, this slide can be threaded with the strap 126 so that, from the sewing flange 125, a segment 127 passes downwardly through the ring 128 and then upwardly through the auxiliary slot 121, behind the bar 128, through the slot 124, around the bar 122, through the slot 123 and around the bar 129. Only the front side 130 of the strap is visible from the side opposite the body side.

Figure 22:
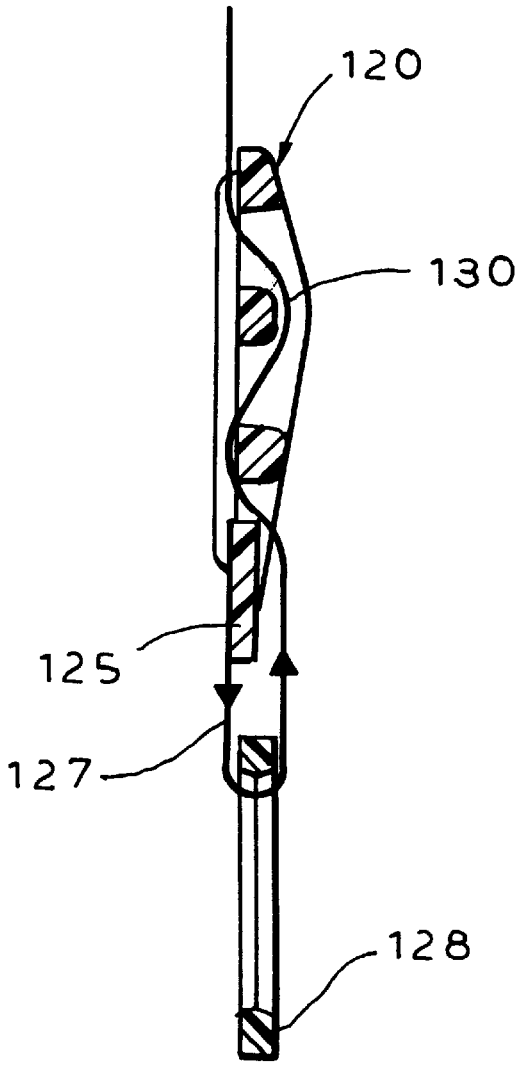
FIG. 22 is a modified threading diagram.

In the threading diagram of FIG. 22, the segment 127 is affixed to the sewing flange 125 and the strap passes around the ring 128 to thread through the slider 120 in the same pattern as in FIG. 21 so that only the front 130 of the strap is visible.

I claim:

1. An adjustable strap assembly for lingerie comprising:

a slide having a frame defined by a pair of parallel outer limbs, transverse limbs interconnecting said outer limbs at opposite ends thereof, respective oval slots along each of said outer limbs, a crossbar interconnecting said transverse limbs between said slots, and a flange adjacent one of said outer limbs, said frame having a side adapted to be turned toward a body of a wearer and a side adapted to be turned away from the body of the wearer, said crossbar being thinner than said outer limbs and being offset toward one of said sides; and strap means for adjustment relative to said slide, said strap means including a strap segment passing through one of said slots from a first of said sides, around said crossbar and out through the other of said slots onto said first of said sides, and means for securing another strap segment to said flange.

2. The assembly defined in claim 1 wherein said strap means is a shoulder strap of a brassiere.

3. The assembly defined in claim 2 wherein said flange is a sewing flange and said means for securing includes stitching through the flange and the strap segment secured thereto.

4. The assembly defined in claim 3 wherein said flange forms a step adjacent said one of said outer limbs, said strap segment secured to said flange lying against said step.

5. The assembly defined in claim 3 wherein said flange defines a further slot between said flange and said one of said outer limbs, said strap segment secured to said flange being looped around said flange and traversing said further slot.

6. The assembly defined in claim 2 wherein said flange is a welding flange and said strap segment secured to said flange is welded thereto.

7. The assembly defined in claim 6 wherein said flange has projections bonded to the strap segment secured to said flange.

8. The assembly defined in claim 6 wherein said flange is formed with a recess open toward said one side and receiving the strap segment secured to the flange.

9. The assembly defined in claim 8 wherein said flange has a flank on a side thereof opposite said recess and having an embossed pattern thereon.

10. The assembly defined in claim 2 wherein said transverse limbs increase in thickness from said outer limbs toward said crossbar.

11. The assembly defined in claim 2 wherein said frame is fully planar on said first side.

12. The assembly defined in claim 2 wherein said outer limbs have sharp edges adjoining the respective slots on said first side.

13. The assembly defined in claim 2 wherein said outer limbs have ridges projecting from said first side adjacent the respective slots.

14. The assembly defined in claim 1 further comprising an auxiliary slot formed in said slide between one of said outer limbs and said flange, said strap means having only one side exposed from said side attached to be turned away from the body of the wearer.

15. The assembly defined in claim 14 wherein the exposed side of said strap means is a shiny side.

16. The assembly defined in claim 1 wherein one of said limbs has an overhang protecting a free end of said other strap segment against wearer.

17. A shoulder-strap slide for lingerie comprising a slide body having a frame defined by a pair of parallel outer limbs, transverse limbs interconnecting said outer limbs at opposite ends thereof, respective oval slots along each of said outer limbs, a crossbar interconnecting said transverse limbs between said slots, and a strap-attachment flange adjacent one of said outer limbs, said frame having a side adapted to be turned toward a body of a wearer and a side to be turned away from the body of the wearer, said crossbar being thinner than said outer limbs and being offset toward one of said sides.

18. The shoulder-strap slide for lingerie defined in claim 17 wherein said flange is a sewing flange to which a strap segment can be secured by stitching through the flange and the strap segment secured thereto.

19. The shoulder-strap slide for lingerie defined in claim 17 wherein said flange forms a step adjacent said one of said outer limbs.

20. The shoulder-strap slide for lingerie defined in claim 17 wherein said flange defines a further slot between said flange and said one of said outer limbs.

21. The shoulder-strap slide for lingerie defined in claim 17 wherein said flange is a welding flange and has projections adapted to be bonded to a strap segment to be secured to said flange.

22. The shoulder-strap slide for lingerie defined in claim 17 wherein said flange is formed with a recess open toward said one side for receiving a strap segment to be secured to the flange.

23. The shoulder-strap slide for lingerie defined in claim 17 wherein said transverse limbs increase in thickness from said outer limbs toward said crossbar.

* * * * *